US010314446B2

(12) United States Patent
Liu et al.

(10) Patent No.: US 10,314,446 B2
(45) Date of Patent: Jun. 11, 2019

(54) SUCTION UNIT

(71) Applicant: Nidec Corporation, Kyoto (JP)

(72) Inventors: Chun-Hsien Liu, Kyoto (JP); Hiroyuki Ichizaki, Kyoto (JP); Bo-Yi Li, Kyoto (JP)

(73) Assignee: Nidec Corporation, Kyoto (JP)

( * ) Notice: Subject to any disclaimer, the term of this patent is extended or adjusted under 35 U.S.C. 154(b) by 86 days.

(21) Appl. No.: 15/591,127

(22) Filed: May 10, 2017

(65) Prior Publication Data

US 2017/0325643 A1 Nov. 16, 2017

(30) Foreign Application Priority Data

May 10, 2016 (JP) ..... 2016-094466
Dec. 28, 2016 (JP) ..... 2016-256648

(51) Int. Cl.

| | |
|---|---|
| ***A47L 5/22*** | (2006.01) |
| ***A47L 9/28*** | (2006.01) |
| ***A47L 9/14*** | (2006.01) |
| ***A47L 9/02*** | (2006.01) |

(52) U.S. Cl.

CPC *A47L 5/22* (2013.01); *A47L 9/02* (2013.01); *A47L 9/1409* (2013.01); *A47L 9/2805* (2013.01); *A47L 9/2842* (2013.01); *A47L 9/2852* (2013.01); *A47L 9/2857* (2013.01); *A47L 9/2894* (2013.01); *A47L 2201/00* (2013.01); *A47L 2201/04* (2013.01)

(58) Field of Classification Search

CPC . A47L 5/22; A47L 9/02; A47L 9/1409; A47L 9/2805; A47L 9/2842; A47L 9/2857; A47L 9/2894; A47L 2201/00; A47L 2201/04

See application file for complete search history.

(56) References Cited

U.S. PATENT DOCUMENTS

2006/0085941 A1* 4/2006 Lee ..... A47L 11/34 15/320
2012/0000033 A1* 1/2012 Conrad ..... A47L 5/28 15/415.1

FOREIGN PATENT DOCUMENTS

| | | |
|---|---|---|
| DE | 102013020935 | 6/2015 |
| JP | H0483156 | 7/1992 |
| JP | 11221177 | 8/1999 |
| JP | 2001178663 | 7/2001 |
| JP | 2002369778 | 12/2002 |

(Continued)

*Primary Examiner* — Dung Van Nguyen
(74) *Attorney, Agent, or Firm* — JCIPRNET

(57) ABSTRACT

Provided is a suction unit to be provided in an electric vacuum cleaner including an electric blower. The suction unit includes a suction inlet arranged to extend in a longitudinal direction, and arranged opposite to a surface to be cleaned; a connection opening to be connected to the electric blower; a suction passage arranged to extend along a center line joining a middle of the suction inlet in the longitudinal direction and a middle of the connection opening in the longitudinal direction to connect the suction inlet and the connection opening; and a plurality of first partition walls each of which is arranged in the suction passage, and is arranged to extend from a side on which the connection opening is defined to a side on which the suction inlet is defined. The suction passage includes a first main passage and a plurality of first division passages.

18 Claims, 13 Drawing Sheets

(56) References Cited

FOREIGN PATENT DOCUMENTS

| | | |
|---|---|---|
| JP | 2008086550 | 4/2008 |
| WO | 2015118940 | 8/2015 |

* cited by examiner

SUCTION UNIT

CROSS-REFERENCE TO RELATED APPLICATION

This application claims the priority benefit of Japan application serial no. 2016-094466, filed on May 10, 2016, and Japan application serial no. 2016-256648, filed on Dec. 28, 2016. The entirety of each of the above-mentioned patent applications is hereby incorporated by reference herein and made a part of this specification.

BACKGROUND OF THE INVENTION

1. Field of the Invention

The present invention relates to a suction unit for sucking air.

2. Description of the Related Art

A known electric vacuum cleaner is disclosed in JP-A 2015-192876. This electric vacuum cleaner includes a case including a suction inlet for air and a discharge outlet for air, and further includes an electric blower and a suction unit arranged on an upstream side of the electric blower in the case.

A suction passage that connects the suction inlet and a connection opening is defined in the suction unit, and the connection opening is arranged opposite to an air inlet (not shown) of the electric blower. In addition, a filter is arranged between the suction inlet and the connection opening. Left and right drive wheels and a trailer wheel are attached to a bottom surface of the case, and the case is thus able to travel on a floor in a room.

If an operation switch of the electric vacuum cleaner having the above-described structure is operated to drive the electric blower, air including waste, such as, for example, dust, is sucked into the suction passage through the suction inlet, and the dust is caught by the filter. Air which has passed through the filter is sucked into the electric blower through the connection opening, and is discharged out of the case through the discharge outlet. The floor is thus cleaned.

However, the above suction unit in related art has a problem in that a turbulent flow of air occurs in the vicinity of the connection opening, resulting in reduced suction efficiency of the suction unit.

SUMMARY OF THE INVENTION

A suction unit according to a preferred embodiment of the present invention is a suction unit to be provided in an electric vacuum cleaner including an electric blower, the suction unit including a suction inlet arranged to extend in a predetermined longitudinal direction, and arranged opposite to a surface to be cleaned; a connection opening to be connected to the electric blower; a suction passage arranged to extend along a center line joining a middle of the suction inlet in the longitudinal direction and a middle of the connection opening in the longitudinal direction to connect the suction inlet and the connection opening; and a plurality of first partition walls each of which is arranged in the suction passage, and is arranged to extend from a side on which the connection opening is defined to a side on which the suction inlet is defined. The suction passage includes a first main passage having the center line of the suction passage passing therethrough; and a plurality of first division passages arranged on both outer sides of the first main passage with respect to the longitudinal direction with one of the first partition walls being arranged between the first main passage and an adjacent one of the first division passages on either side of the first main passage. The first main passage and the first division passages are divided from one another in the longitudinal direction of the suction inlet by the first partition walls.

The suction unit according to the above preferred embodiment of the present invention is able to achieve improved suction efficiency.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 3:
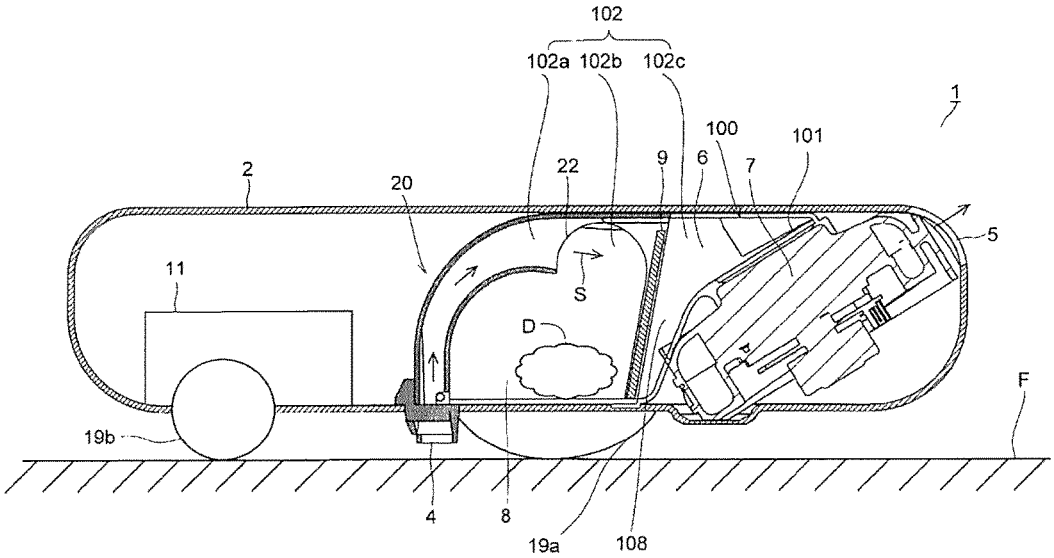
FIG. 3 is a side sectional view of the electric vacuum cleaner including the suction unit according to the first preferred embodiment of the present invention.

Hereinafter, preferred embodiments of the present invention will be described in detail with reference to the accompanying drawings. It is assumed herein that a direction toward a floor F (i.e., a surface to be cleaned) illustrated in FIG. 3 is a downward direction, while a direction away from the floor F is an upward direction. It is also assumed herein that, with respect to a front-rear direction, a direction leading from an electric blower 7 to a suction inlet 4 is a forward direction, while a direction leading from the suction inlet 4 to the electric blower 7 is a rearward direction. It is also assumed herein that a direction perpendicular to the front-rear direction and parallel to the floor F is a right-left direction (i.e., a longitudinal direction). It is also assumed herein that a surface parallel to the front-rear direction and perpendicular to the right-left direction is referred to as a "side surface". It is also assumed herein that an upstream side and a downstream side are defined with respect to a direction in which air sucked in through the suction inlet 4 when the electric blower 7 is in operation flows. It is also assumed herein that the wording "the suction inlet 4 arranged opposite to the floor F (i.e., the surface to be cleaned)" and the like can refer to a situation in which the suction inlet 4 and the floor F face each other with another member (e.g., a rotary brush, etc.) arranged therebetween, in addition to a situation in which the suction inlet 4 and the floor F face each other directly with no other member arranged between the suction inlet 4 and the floor F.

Figure 1:
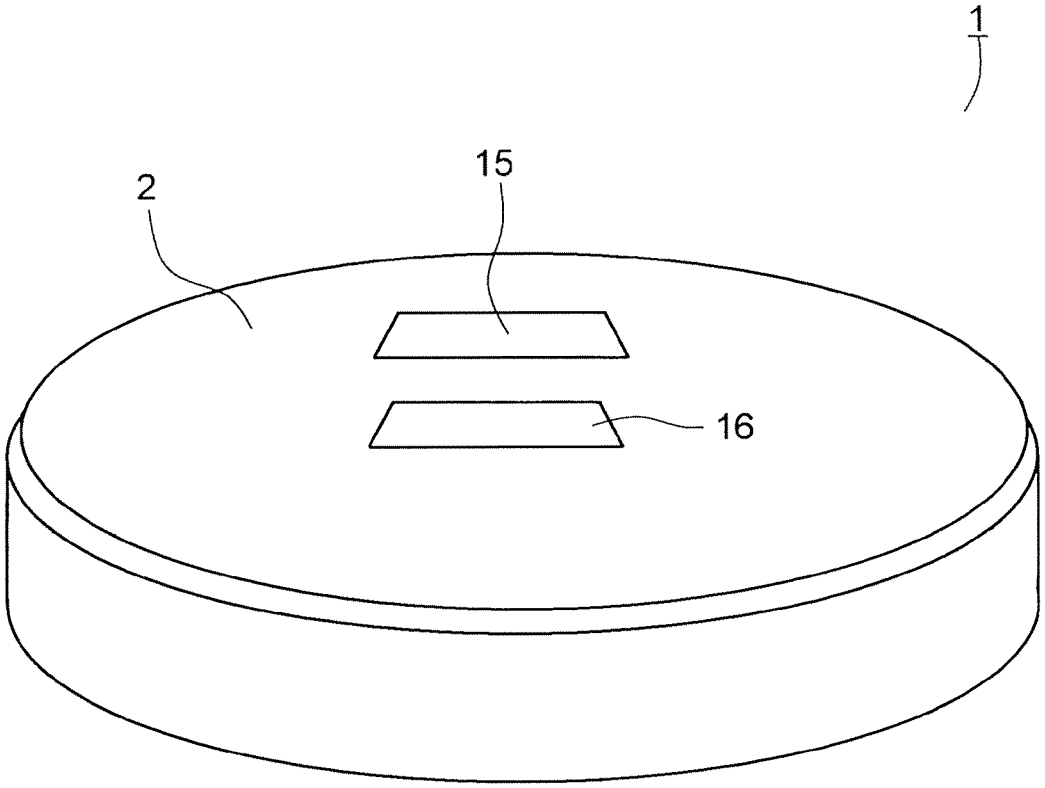
FIG. 1 is a perspective view of an electric vacuum cleaner including a suction unit according to a first preferred embodiment of the present invention.
Figure 2:
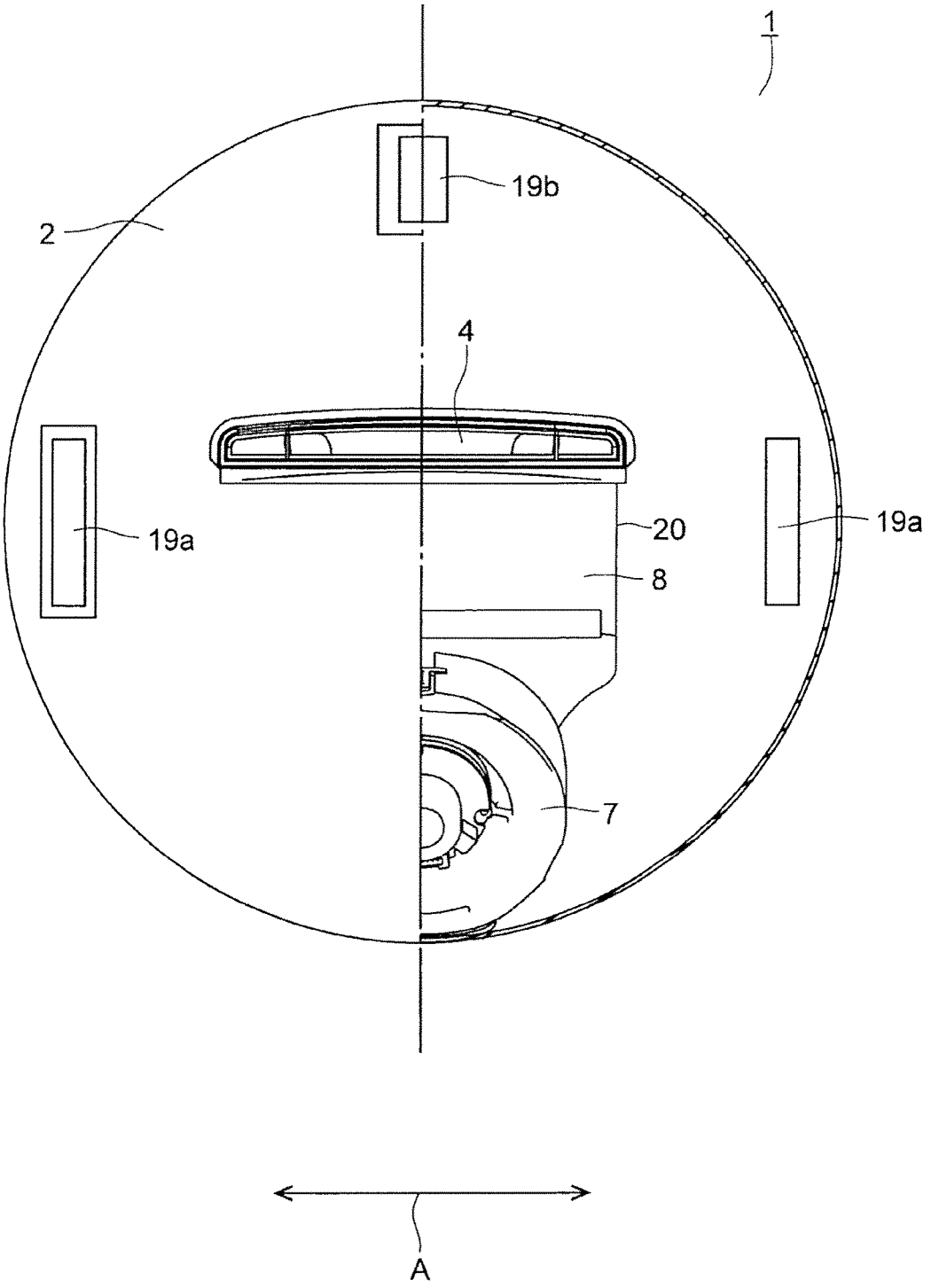
FIG. 2 is a bottom view of the electric vacuum cleaner including the suction unit according to the first preferred embodiment of the present invention.

An electric vacuum cleaner 1 according to a first preferred embodiment of the present invention will be described below. FIGS. 1, 2, and 3 are a perspective view, a bottom view, and a side sectional view, respectively, of the electric vacuum cleaner 1 according to the first preferred embodiment. The electric vacuum cleaner 1 is a so-called robot-type electric vacuum cleaner, and includes a case 2 which is substantially circular in a horizontal section (i.e., a section parallel to the floor F).

A display portion 15 and an operation portion 16 are arranged in an upper surface of the case 2. The operation portion 16 includes a plurality of buttons (not shown). By operating the operation portion 16, a user can, for example, issue an instruction to turn on or off the electric vacuum cleaner 1, issue an instruction to change the rotation rate of the electric blower 7, which will be described below, or enter a condition, such as, for example, a time at which the electric vacuum cleaner 1 is to start cleaning. The display portion 15 includes, for example, a liquid crystal display panel or the like, and displays, for example, the condition entered with the operation portion 16.

In addition, a position sensor (not shown) is arranged in the upper surface of the case 2. The position sensor is used to detect the position of the electric vacuum cleaner 1 in a room, for example.

The suction inlet 4, which is arranged to extend in the right-left direction (i.e., a longitudinal direction A), is defined in a bottom surface (i.e., a lower surface) of the case 2, and a discharge outlet 5, which is arranged to extend in the right-left direction, is defined in a rear portion of the case 2. The suction inlet 4 is arranged opposite to the floor F (i.e., the surface to be cleaned) inside the room, and the discharge outlet 5 is arranged to face obliquely rearward and upward from the case 2. A rotary brush (not shown) is arranged in the vicinity of the suction inlet 4 in a bottom portion of the case 2. Note that the rotary brush may alternatively be arranged in the suction inlet 4.

An air passage 6, which connects the suction inlet 4 and the discharge outlet 5, is arranged inside of the case 2. The electric blower 7, which is arranged to produce an air flow, is arranged in the air passage 6. Once the electric blower 7 is driven, air in the room flows into the air passage 6 through the suction inlet 4 as indicated by arrows S, and is sent out into the room through the discharge outlet 5. A centrifugal fan is preferably used as the electric blower 7, but other types of electric blowers, such as, for example, an axial fan, may alternatively be used.

In the case 2, a suction unit 100 is arranged on the upstream side of the electric blower 7, and the suction unit 100 includes a suction passage 102, a dust collection portion 8, and a filter 9. The suction unit 100 is provided in, for example, the electric vacuum cleaner 1 including the electric blower 7.

The suction passage 102 defines a channel on the upstream side of the electric blower 7 in the air passage 6, and connects the suction inlet 4 and a connection opening 101. The connection opening 101 is arranged opposite to an air inlet (not shown) of the electric blower 7, and air flowing in the suction passage 102 is sucked into the electric blower 7 through the connection opening 101. That is, the connection opening 101 is connected to the electric blower 7. The suction passage 102 is divided into a first suction passage 102*a*, a second suction passage 102*b*, and a third suction passage 102*c*, which are arranged in the order named from the upstream side to the downstream side with respect to a direction in which the air flows.

The first suction passage 102*a* is defined by a suction nozzle 20, which is detachably fitted in the case 2, and the first suction passage 102*a* is arranged to connect the suction inlet 4 and an outlet 22, which is open at a downstream end of the suction nozzle 20. The suction inlet 4 is arranged to extend in the predetermined longitudinal direction A, and is arranged opposite to the floor F (i.e., the surface to be cleaned). The width of the outlet 22 measured in the longitudinal direction A is arranged to be smaller than the width of the suction inlet 4 measured in the longitudinal direction A (see FIG. 5).

The first suction passage 102*a* is arranged to extend upward from the suction inlet 4 and curve rearward, and is connected to the second suction passage 102*b* through the outlet 22.

The second suction passage 102*b* is arranged on the downstream side of the first suction passage 102*a*, and the dust collection portion 8 is arranged below the second suction passage 102*b*. An upper side of a front portion of the dust collection portion 8 is covered with the suction nozzle 20, and an upper side of a rear portion of the dust collection portion 8 is open and in communication with the second suction passage 102*b*. That is, the dust collection portion 8 is arranged below the suction passage 102, and the rear portion of the dust collection portion 8 is arranged to open into a portion of the suction passage 102 on the upper side thereof.

The second and third suction passages 102*b* and 102*c* are arranged to be in communication with each other through the filter 9. The filter 9 is arranged to extend up to a bottom surface of the dust collection portion 8 to cover the entire rear side of the dust collection portion 8. An airway 108 is arranged below the third suction passage 102*c*, and the airway 108 and the dust collection portion 8 are arranged to be in communication with each other through the filter 9.

Each of the third suction passage 102*c* and the airway 108 is arranged to decrease in a channel width (i.e., width in the longitudinal direction A) toward the connection opening 101, and the connection opening 101 is arranged to face obliquely forward and upward.

Dust included in air flowing from the second suction passage 102*b* into the third suction passage 102*c* is caught by the filter 9, and is collected in the dust collection portion 8, which is defined in the shape of a container. Air which has flowed from the second suction passage 102*b* into the third suction passage 102*c* through the filter 9, and air which has flowed from the dust collection portion 8 into the airway 108 through the filter 9, are sucked into the electric blower 7 through the connection opening 101. Each of the suction nozzle 20, the dust collection portion 8, and the filter 9 is detachably fitted in the case 2.

Left and right drive wheels 19*a* are arranged at left and right end portions of the bottom surface of the case 2. A trailer wheel 19*b*, which is defined by a caster, is arranged at a front end portion of the bottom surface of the case 2. Each drive wheel 19*a* is connected to a drive motor (not shown). The case 2 is thus able to travel on the floor F.

In addition, the electric vacuum cleaner 1 includes a control portion (not shown) which controls various portions of the electric vacuum cleaner 1. The electric blower 7, the display portion 15, the operation portion 16, the drive motor, the position sensor, a storage portion, and so on are connected to the control portion. The storage portion is arranged to store a control program for the electric vacuum cleaner 1 and, in addition, the condition entered with the operation portion 16 and so on.

A power supply portion 11 including a secondary battery and so on is arranged in a front portion of the case 2. The power supply portion 11 is arranged to supply power to the electric blower 7, the control portion, the drive motor, and so on, and includes a case-side contact point (not shown) exposed in the bottom surface of the case 2. The case-side contact point is arranged to make contact with a charger stand-side contact point of a charger stand (not shown) connected to a commercial power supply (not shown). The secondary battery of the power supply portion 11 is thus charged through the charger stand. Before a cleaning operation is started, the electric vacuum cleaner 1 is placed on the charger stand.

Figure 4:
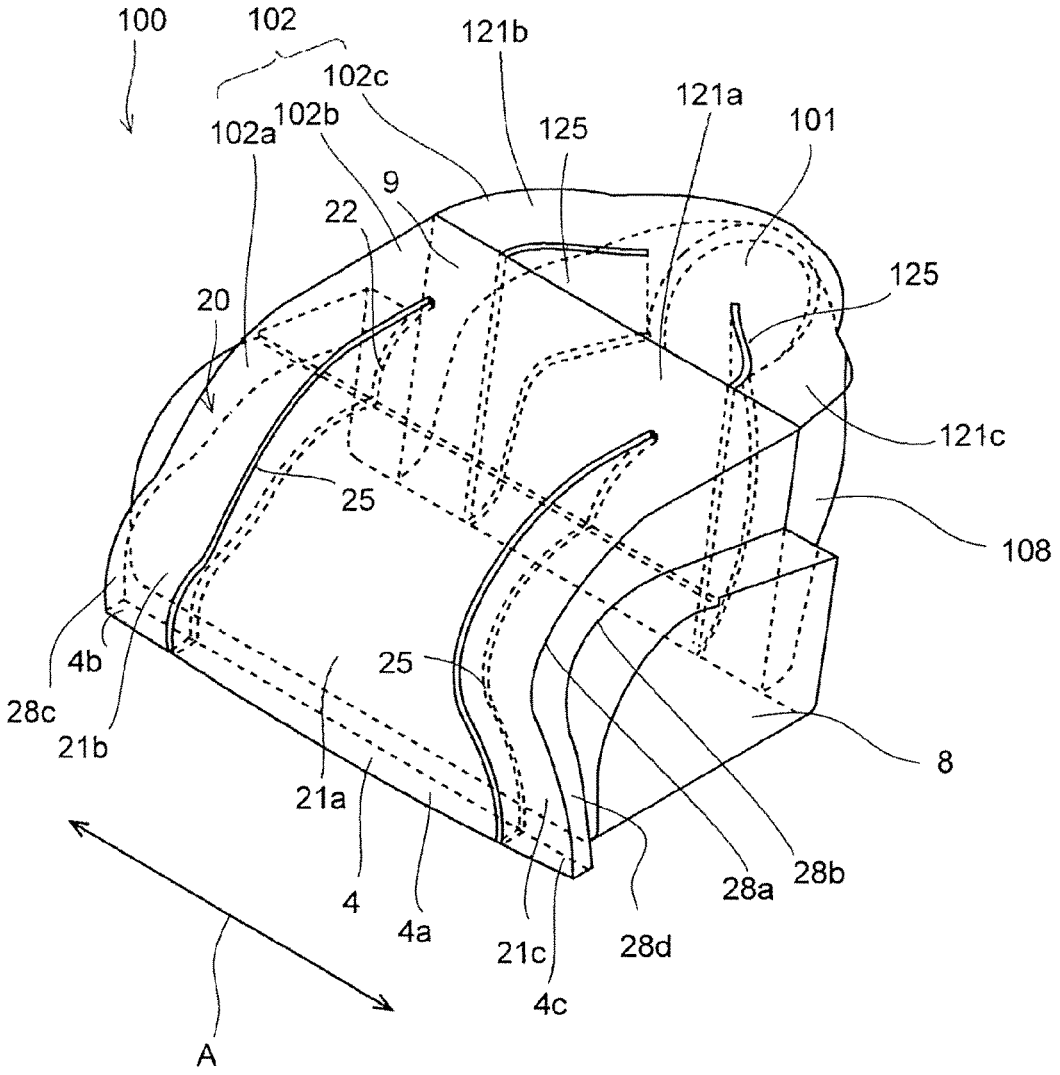
FIG. 4 is a perspective view of the suction unit according to the first preferred embodiment of the present invention.
Figure 5:
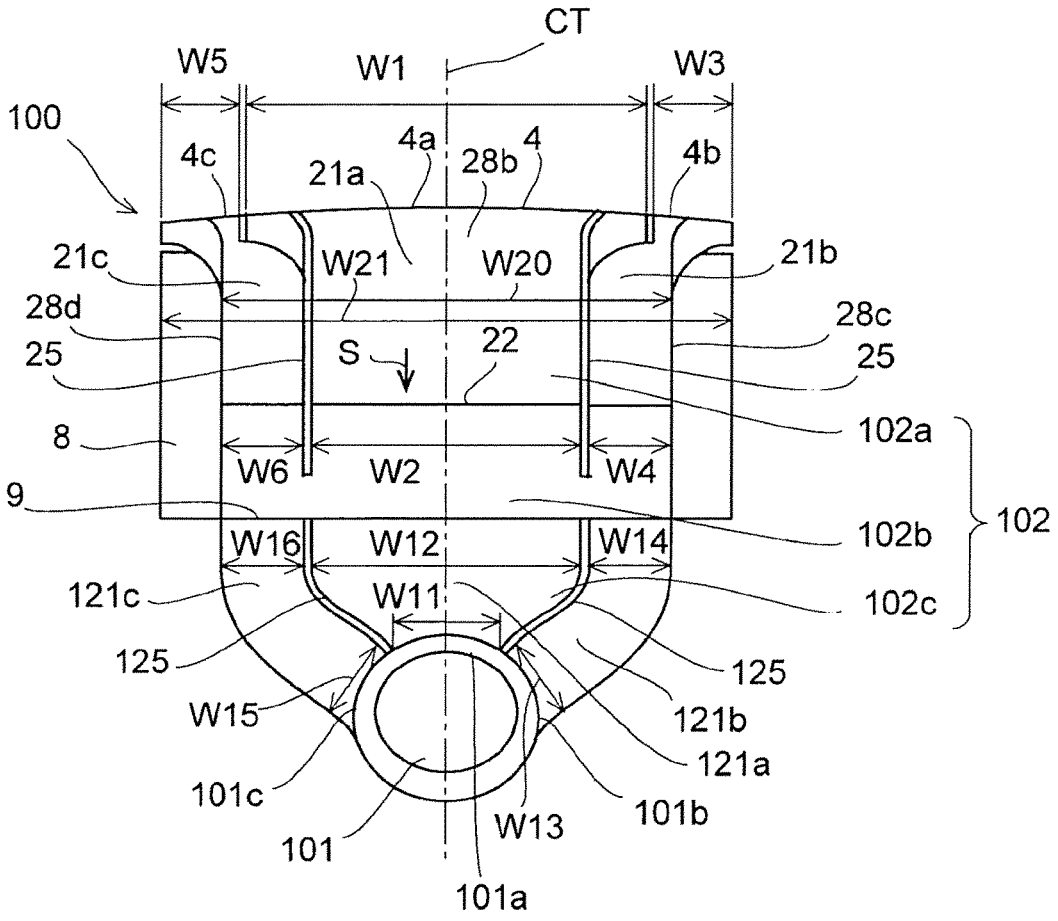
FIG. 5 is a sectional plan view of the suction unit according to the first preferred embodiment of the present invention.

FIGS. 4 and 5 are a perspective view and a sectional plan view, respectively, of the suction unit 100. The suction passage 102 is arranged to extend along a center line CT, which joins a middle of the suction inlet 4 in the longitudinal direction A, a middle of the outlet 22 in the longitudinal direction A, and a middle of the connection opening 101 in the longitudinal direction A, to connect the suction inlet 4 and the connection opening 101.

Upper surfaces of the first, second, and third suction passages 102*a*, 102*b*, and 102*c* are defined by an upper wall 28*a*, and left and right surfaces thereof are defined by a side wall 28*c* and a side wall 28*d*, respectively. In addition, a lower surface of the first suction passage 102*a* is defined by a lower wall 28*b*. Lower sides of the second and third suction passages 102*b* and 102*c* are not defined by the lower wall 28*b*, but are open and in communication with the dust collection portion 8 and the airway 108, respectively.

Each of the upper wall 28*a* and the lower wall 28*b* is arranged to slant in such a manner as to increase in height as the upper wall 28*a* or the lower wall 28*b* extends rearward along the first suction passage 102*a*, and air which has flowed into the first suction passage 102*a* through the suction inlet 4 is guided upward and rearward, and passes through the outlet 22.

A bottom surface of the airway 108 is also arranged to slant in such a manner as to increase in height as the bottom surface extends rearward, and the air which has flowed from the dust collection portion 8 into the airway 108 is guided upward and rearward, and is sucked into the connection opening 101.

In the first suction passage 102*a*, a plurality of (two in the present preferred embodiment) partition walls (i.e., second partition walls) 25 are arranged side by side in the longitudinal direction A. An upper end and a lower end of each partition wall 25 are arranged to be continuous with the upper wall 28*a* and the lower wall 28*b*, respectively, and are arranged to extend from the suction inlet 4 to the outlet 22.

As a result, the first suction passage 102*a* is divided into a main passage (i.e., a second main passage) 21*a* and a plurality of (two in the present preferred embodiment) division passages (i.e., second division passages) 21*b* and 21*c*. The main passage 21*a* has the center line CT of the suction passage 102 passing therethrough. The division passages 21*b* and 21*c* are arranged on both outer sides of the main passage 21*a* with respect to the longitudinal direction A with one of the partition walls 25 being arranged between the main passage 21*a* and an adjacent one of the division passages 21*b* and 21*c* on either side of the main passage 21*a*.

That is, the suction unit 100 includes the plurality of partition walls (i.e., the second partition walls) 25, each of which is arranged in the suction passage 102 and is arranged to extend from a side on which the suction inlet 4 is defined to a side on which the connection opening 101 is defined, and the suction passage 102 includes the main passage (i.e., the second main passage) 21*a*, which has the center line CT of the suction passage 102 passing therethrough, and the plurality of division passages (i.e., the second division passages) 21*b* and 21*c*, which are arranged on both outer sides of the main passage 21*a* with respect to the longitudinal direction A with one of the partition walls 25 being arranged between the main passage 21*a* and an adjacent one of the division passages 21*b* and 21*c* on either side of the main passage 21*a*, the main passage 21*a* and the division passages 21*b* and 21*c* being divided from one another in the longitudinal direction A of the suction inlet 4 by the partition walls 25. This prevents a narrowing of a channel on a side closer to the air inlet of the electric blower 7 from causing flows of air sucked in through both end portions of the suction inlet 4 with respect to the longitudinal direction A to abruptly bend toward the center line CT immediately after entering into the first suction passage 102*a*, and thus contributes to reducing turbulence in the air.

In addition, the suction inlet 4 is divided by the partition walls 25 into suction inlets 4*a*, 4*b*, and 4*c*. The suction inlets 4*a*, 4*b*, and 4*c* are arranged at upstream ends of the main passage 21*a*, the division passage 21*b*, and the division passage 21*c*, respectively. Each of the suction inlets 4*b* and 4*c* is arranged adjacent to the suction inlet 4*a*.

Each partition wall 25 is arranged to curve in such a direction as to decrease the width of the main passage 21*a* measured in the longitudinal direction A in the vicinity of the suction inlet 4, and then extend in a direction substantially perpendicular to the longitudinal direction A from the upstream side to the downstream side with respect to the direction in which the air flows.

In addition, each of the side walls 28*c* and 28*d* is arranged to curve in such a direction as to decrease the width of the first suction passage 102*a* measured in the longitudinal direction A and extend along an adjacent one of the partition walls 25 in the vicinity of the suction inlet 4 of the first suction passage 102*a*, and then extend in a direction substantially perpendicular to the longitudinal direction A from the upstream side to the downstream side with respect to the direction in which the air flows.

Thus, upstream portions and downstream portions of the division passages 21*b* and 21*c* are arranged to have equal channel widths. That is, the upstream portions of the division passages (i.e., the second division passages) 21*b* and 21*c* are arranged to have equal channel widths. Note that the term "equal" as used herein includes both "exactly equal" and "substantially equal".

In addition, a width W20 of the suction passage 102 measured in the longitudinal direction A of the suction inlet 4 is arranged to be smaller than a width W21 of the dust collection portion 8 measured in the longitudinal direction A of the suction inlet 4. As a result, a space in which a handle or the like is arranged can be secured above an upper surface of the dust collection portion 8.

In addition, an upstream end of each partition wall 25 is arranged outward of a downstream end thereof with respect to the longitudinal direction A, so that a width W1 of the main passage 21*a* at the suction inlet 4*a* measured in the longitudinal direction A is greater than a width W2 of the main passage 21*a* at the outlet 22 measured in the longitudinal direction A.

In addition, a width W3 of the suction inlet 4*b* measured in the longitudinal direction A and a width W5 of the suction inlet 4*c* measured in the longitudinal direction A are arranged to be substantially equal to each other, and the width W1 of the suction inlet 4*a* is arranged to be greater than the width W3 of the suction inlet 4*b* and the width W5 of the suction inlet 4*c*. A width W4 of the division passage 21*b* at the outlet 22 measured in the longitudinal direction A and a width W6 of the division passage 21*c* at the outlet 22 measured in the longitudinal direction A are arranged to be substantially equal to each other. In addition, each of the width W4 of the division passage 21*b* at the outlet 22 and the width W6 of the division passage 21*c* at the outlet 22 is arranged to be smaller than the width W2 of the main passage 21*a* at the outlet 22.

In the third suction passage 102*c*, a plurality of (two in the present preferred embodiment) partition walls (i.e., first partition walls) 125 are arranged side by side in the longitudinal direction A. An upper end and a lower end of each partition wall 125 are arranged to be continuous with the upper wall 28*a* and the bottom surface of the airway 108, respectively, and are arranged to extend from the side on which the connection opening 101 is defined to the filter 9. An upstream end of each partition wall 125 is arranged to be in contact with the filter 9. That is, the upstream end of each partition wall (i.e., each first partition wall) 125 is arranged on a side of a channel midpoint between the suction inlet 4 and the connection opening 101 in the suction passage 102 closer to the connection opening 101. In addition, a lower end of the upstream end of each partition wall 125 is arranged at a level lower than that of a lower end of a downstream end of the partition wall 125. Further, the upstream end of each partition wall (i.e., each first partition wall) 125 and the downstream end of each partition wall (i.e., each second partition wall) 25 are spaced from each other.

Thus, the third suction passage 102*c* is divided into a main passage (i.e., a first main passage) 121*a* and a plurality of (two in the present preferred embodiment) division passages (i.e., first division passages) 121*b* and 121*c*. The main passage 121*a* has the center line CT of the suction passage 102 passing therethrough. The division passages 121*b* and 121*c* are arranged on both outer sides of the main passage 121*a* with respect to the longitudinal direction A with one of the partition walls 125 being arranged between the main passage 121*a* and an adjacent one of the division passages 121*b* and 121*c* on either side of the main passage 121*a*.

That is, the suction unit 100 includes the suction passage 102, which is arranged to extend along the center line CT joining the middle of the suction inlet 4 in the longitudinal direction A and the middle of the connection opening 101 in the longitudinal direction A to connect the suction inlet 4 and the connection opening 101, and the plurality of partition walls (i.e., the first partition walls) 125, each of which is arranged in the suction passage 102 and is arranged to extend from the side on which the connection opening 101 is defined to the side on which the suction inlet 4 is defined, and the suction passage 102 includes the main passage (i.e., the first main passage) 121*a*, which has the center line CT of the suction passage 102 passing therethrough, and the plurality of division passages (i.e., the first division passages) 121*b* and 121*c*, which are arranged on both outer sides of the main passage 121*a* with respect to the longitudinal direction A with one of the partition walls 125 being arranged between the main passage 121*a* and an adjacent one of the division passages 121*b* and 121*c* on either side of the main passage 121*a*, the main passage 121*a* and the division passages 121*b* and 121*c* being divided from one another in the longitudinal direction A of the suction inlet 4 by the partition walls 125.

In addition, an edge of the connection opening 101 is divided into connection portions 101*a*, 101*b*, and 101*c* by the partition walls 125. The connection portions 101*a*, 101*b*, and 101*c* are arranged at downstream ends of the main passage 121*a* and the division passages 121*b* and 121*c*, respectively. Each of the connection portions 101*b* and 101*c* is arranged adjacent to the connection portion 101*a*.

Each partition wall 125 is arranged to extend from the upstream end thereof in a direction substantially perpendicular to the longitudinal direction A from the upstream side to the downstream side with respect to the direction in which the air flows, and then bend to the side of the center line CT (i.e., inward with respect to the longitudinal direction A) and extend in a straight line toward the connection opening 101.

In addition, at the third suction passage 102*c*, each of the side walls 28*c* and 28*d* is arranged to extend in a direction substantially perpendicular to the longitudinal direction A along an adjacent one of the partition walls 125 from the upstream side to the downstream side with respect to the direction in which the air flows, and then bend to the side of the center line CT (i.e., inward with respect to the longitudinal direction A) and extend in a straight line toward the connection opening 101.

Thus, upstream portions and downstream portions of the division passages 121*b* and 121*c* are arranged to have equal channel widths. That is, the upstream portions of the division passages (i.e., the first division passages) 121*b* and 121*c* are arranged to have equal channel widths. Note that the term "equal" as used herein includes both "exactly equal" and "substantially equal".

In addition, the downstream end of each partition wall 125 is arranged inward of the upstream end thereof with respect to the longitudinal direction A, so that a width W11 of the main passage 121*a* at the downstream end thereof measured in the longitudinal direction A is smaller than a width W12 of the main passage 121*a* at an upstream end thereof measured in the longitudinal direction A.

In addition, a width W13 of the connection portion 101*b* and a width W15 of the connection portion 101*c* are arranged to be equal to each other, and the width W11 of the connection portion 101*a* is arranged to be smaller than the width W13 of the connection portion 101*b* and the width W15 of the connection portion 101*c*. That is, the width W11 of the downstream end of the main passage (i.e., the first main passage) 121*a* is different from each of the widths W13 and W15 of the downstream ends of the division passages (i.e., the first division passages) 121*b* and 121*c*, respectively. A width W14 of an upstream end of the division passage 121*b* measured in the longitudinal direction A and a width W16 of an upstream end of the division passage 121*c* measured in the longitudinal direction A are arranged to be equal to each other. In addition, each of the widths W14 and W16 of the upstream ends of the division passages 121*b* and 121*c*, respectively, is arranged to be smaller than the width W12 of the upstream end of the main passage 121*a*. Note that the term "equal" as used herein includes both "exactly equal" and "substantially equal".

In addition, the width W12 of the main passage 121*a* at the upstream end thereof measured in the longitudinal direction A is arranged to be equal to the width W2 of the main passage 21*a* at the outlet 22 measured in the longitudinal direction A. In addition, the widths W14 and W16 of the upstream ends of the division passages 121*b* and 121*c*, respectively, are arranged to be equal to, respectively, the widths W4 and W6 of the division passages 21*b* and 21*c*, respectively, at the outlet 22. Note that the term "equal" as used herein includes both "exactly equal" and "substantially equal".

Note that each of the number of partition walls 25 and the number of partition walls 125 is not limited to two, but may alternatively be an even number equal to or greater than four. In this case, each of the first suction passage 102*a* and the third suction passage 102*c* is divided into one main passage and an even number of division passages, the even number being equal to or greater than four.

If a cleaning start time previously stored in the storage portion of the electric vacuum cleaner 1 having the above-described structure comes, the case 2 leaves the charger stand and automatically travels on the floor F. At this time, the electric blower 7 is driven, and the rotary brush is caused to rotate. The cleaning operation of the electric vacuum cleaner 1 is thus started. Air flows including dust on the floor F enter into the main passage 21*a* and the division passages 21*b* and 21*c* through the suction inlets 4*a*, 4*b*, and 4*c*, respectively, as indicated by arrows S (see FIG. 5).

At this time, the upstream portions and the downstream portions of the division passages 21*b* and 21*c* are arranged to have equal channel widths, and this contributes to preventing a suction force in each of the division passages 21*b* and 21*c* from decreasing from the upstream side toward the downstream side with respect to the direction in which the air flows.

In addition, the width W1 of the suction inlet 4*a* of the main passage 21*a*, where turbulence does not easily occur, is arranged to be greater than the widths W3 and W5 of the suction inlets 4*b* and 4*c*, respectively, and this leads to improved suction efficiency of the suction nozzle 20.

In addition, after passing in the main passage 21*a* and the division passages 21*b* and 21*c*, the air flows enter into the second suction passage 102*b* through the outlet 22. A portion of the air flows passing in the second suction passage 102*b* enters into the dust collection portion 8. Dust D in the air is caught by the filter 9, and is collected in the dust collection portion 8 (see FIG. 3).

At this time, due to the dust collection portion 8 being arranged below the suction passage 102, and the rear portion of the dust collection portion 8 being arranged to open into the suction passage 102 on the upper side, the suction unit 100 is able to easily achieve improved suction efficiency and cleaning efficiency.

In addition, due to the dust collection portion 8 being arranged below the suction passage 102, the air flows in a laminar state in the suction passage 102. Accordingly, the dust D can be smoothly sucked in through even the suction inlets 4*b* and 4*c* at both end portions with respect to the longitudinal direction A without an increase in the rotation rate of the electric blower 7. This contributes to reducing turbulence in the dust collection portion 8, and preventing the dust D accumulated in the dust collection portion 8 from being rescattered.

The air which has flowed from the second suction passage 102*b* into the third suction passage 102*c* through the filter 9 is sucked into the electric blower 7 through the connection opening 101. In addition, air in the dust collection portion 8 flows into the airway 108 through the filter 9, and is sucked into the electric blower 7 through the connection opening 101. The air passes through the electric blower 7, and is discharged out of the case 2 through the discharge outlet 5. The floor F is cleaned in the above-described manner.

At this time, the partition walls 125, extending from the connection opening 101 in the third suction passage 102*c*, contribute to reducing the likelihood of an occurrence of turbulence in the vicinity of the connection opening 101. Thus, the air flows can smoothly enter into the connection opening 101 from the main passage 121*a* and the division passages 121*b* and 121*c* resulting in improved suction efficiency of the suction unit 100.

In addition, the upstream end of each partition wall 125 is arranged on the side of the channel midpoint between the suction inlet 4 and the connection opening 101 in the suction passage 102 closer to the connection opening 101. This contributes to further reducing the likelihood of the occurrence of turbulence in the vicinity of the connection opening 101, and to a smoother flow of air.

In addition, the division passages 121*b* and 121*c* are arranged to have equal channel widths, and the widths W13 and W15 of the downstream ends of the division passages 121*b* and 121*c* on the left and right sides, respectively, are equal to each other. This causes suction forces of equivalent magnitude to act in the division passages 121*b* and 121*c*, resulting in improved suction efficiency of the suction unit 100.

In addition, the lower end of the upstream end of each partition wall 125 is arranged at a level lower than that of the lower end of the downstream end of the partition wall 125, and this enables an air flow passing upward and toward the connection opening 101 in the third suction passage 102*c* to smoothly enter into the connection opening 101.

In addition, the upstream end of each partition wall (i.e., each first partition wall) 125 and the downstream end of each partition wall (i.e., each second partition wall) 25 are spaced from each other, and this contributes to reducing the likelihood of an occurrence of an air flow passing upward from the dust collection portion 8 into the second suction passage 102*b*, enabling air to flow in the laminar state in the second suction passage 102*b*. This leads to improved suction efficiency of the suction unit 100.

In addition, the upstream portions of the division passages (i.e., the first division passages) 121*b* and 121*c* and the downstream portions of the division passages (i.e., the second division passages) 21*b* and 21*c* are arranged to have equal channel widths, and this contributes to preventing suction forces in the upstream portions of the division passages (i.e., the first division passages) 121*b* and 121*c* and the downstream portions of the division passages (i.e., the second division passages) 21*b* and 21*c* from decreasing from the upstream side toward the downstream side with respect to the direction in which the air flows.

In addition, the width W1 of the upstream end of the main passage (i.e., the second main passage) 21*a* measured in the longitudinal direction A is arranged to be greater than the width W11 of the downstream end of the main passage (i.e., the first main passage) 121*a* measured in the longitudinal direction A. This contributes to increasing suction forces acting in the main passage (i.e., the second main passage) 21*a* and the main passage (i.e., the first main passage) 121*a*. This leads to improved suction efficiency of the suction unit 100.

After traveling over the entire floor F while keeping the electric blower 7 in operation, the electric vacuum cleaner 1 returns to the charger stand, and the electric blower 7 is stopped. The cleaning operation of the electric vacuum cleaner 1 is thus completed.

Figure 6:
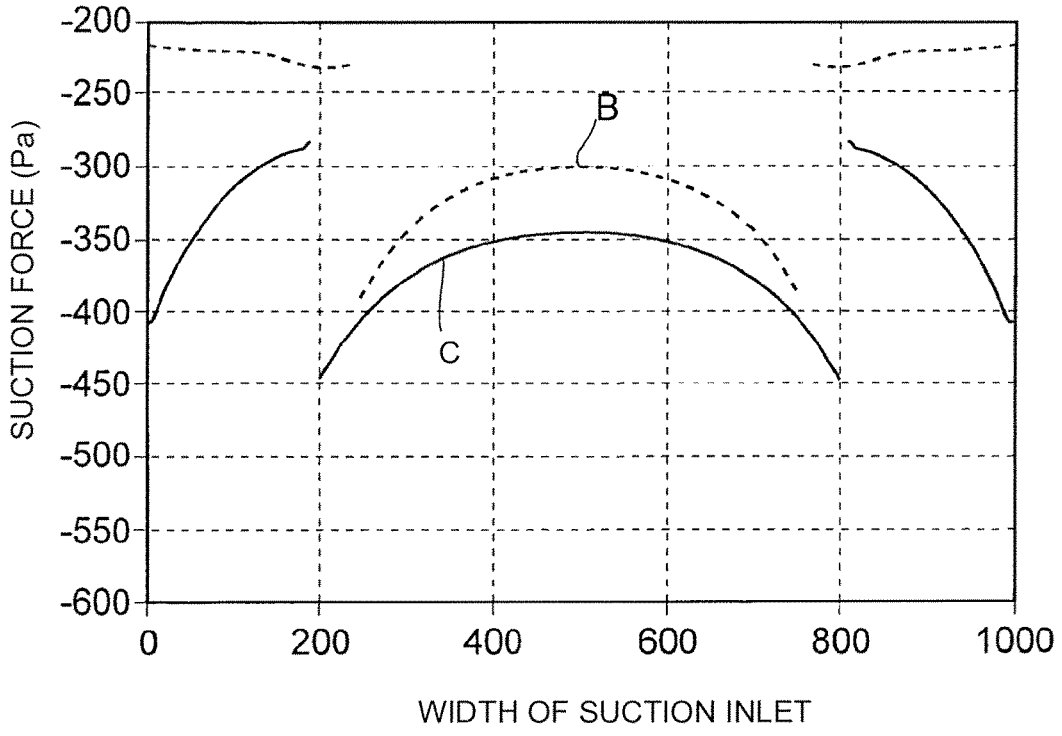
FIG. 6 is a graph showing a result of a simulation of an air pressure distribution in a suction inlet of the suction unit according to the first preferred embodiment of the present invention.

FIG. 6 is a graph showing a result of a simulation of an air pressure distribution in the suction inlet 4. The vertical axis represents the suction force (measured in Pa), while the horizontal axis represents the position in the suction inlet 4 along the longitudinal direction A. A division ranging from 200 to 800 units along the horizontal axis shows an air velocity distribution in the suction inlet 4*a*, and a division ranging from 0 to 200 units along the horizontal axis shows an air velocity distribution in the suction inlet 4*b*. In addition, a division ranging from 800 to 1000 units along the horizontal axis shows an air velocity distribution in the suction inlet 4*c*.

A solid line C represents an air velocity distribution of the suction unit 100 according to the present preferred embodiment, while a broken line B represents an air velocity distribution of a suction unit according to a comparative example. In the suction unit according to the comparative example, the upstream portions and the downstream portions of the division passages 21*b* and 21*c* are not arranged to have equal channel widths, and the partition walls 125 are not provided.

Compared to the suction unit according to the comparative example, the suction unit 100 according to the present preferred embodiment exhibits an improvement in the suction forces over the entire extent of the suction inlet 4 in the longitudinal direction A. In addition, air velocity distributions were measured at a plurality of positions along the direction in which the air flows in each of the downstream portions of the division passages (i.e., the first division passages) 121*b* and 121*c*. This measurement showed that a decrease in the suction force from the upstream side toward the downstream side in each of the division passages 21*b* and 21*c* occurs less easily in the suction unit 100 according to the present preferred embodiment than in the suction unit according to the comparative example.

The suction unit 100 according to the present preferred embodiment includes the plurality of partition walls (i.e., the first partition walls) 125, which are arranged to extend from the connection opening 101 to the side on which the suction inlet 4 is defined in the suction passage 102 connecting the suction inlet 4 and the connection opening 101, and includes the main passage (i.e., the first main passage) 121*a* having the center line CT of the suction passage 102 passing therethrough, and the plurality of division passages (i.e., the first division passages) 121*b* and 121*c* arranged on both outer sides of the main passage 121*a* with respect to the longitudinal direction A with one of the partition walls 125 being arranged between the main passage 121*a* and an adjacent one of the division passages 121*b* and 121*c* on either side of the main passage 121*a*, the main passage 121*a* and the division passages 121*b* and 121*c* being divided from one another in the longitudinal direction A of the suction inlet 4 by the partition walls 125.

Thus, the partition walls 125 extending from the connection opening 101 are arranged in the third suction passage 102*c*, and this contributes to reducing the likelihood of the occurrence of turbulence in the vicinity of the connection opening 101. Thus, the air flows can smoothly enter into the connection opening 101 from the main passage 121*a* and the division passages 121*b* and 121*c*, resulting in improved suction efficiency of the suction unit 100.

In addition, the upstream end of each partition wall 125 is arranged on the side of the channel midpoint between the suction inlet 4 and the connection opening 101 in the suction passage 102 closer to the connection opening 101. This contributes to further reducing the likelihood of the occurrence of turbulence in the vicinity of the connection opening 101, and to a smoother flow of air.

In addition, the width W11 of the downstream end of the main passage 121*a* is arranged to be different from each of the widths W13 and W15 of the downstream ends of the division passages 121*b* and 121*c*, respectively, and this leads to improved flexibility in designing the suction unit 100.

In addition, the widths W13 and W15 of the downstream ends of the division passages 121*b* and 121*c* on the left and right sides, respectively, are equal to each other, and this causes suction forces of equivalent magnitude to act in the division passages 121*b* and 121*c*. This leads to improved suction efficiency of the suction unit 100.

In addition, due to the dust collection portion 8 being arranged below the suction passage 102, and the rear portion of the dust collection portion 8 being arranged to open into the suction passage 102 on the upper side, the suction unit 100 is able to easily achieve improved suction efficiency and cleaning efficiency.

In addition, the lower end of the upstream end of each partition wall 125 is arranged at a level lower than that of the lower end of the downstream end of the partition wall 125, and this enables an air flow passing upward and toward the connection opening 101 in the suction passage 102 to smoothly enter into the connection opening 101.

In addition, the width W20 of the suction passage 102 measured in the longitudinal direction A of the suction inlet 4 is arranged to be smaller than the width W21 of the dust collection portion 8 measured in the longitudinal direction A of the suction inlet 4, so that the space in which the handle or the like is arranged can be secured above the upper surface of the dust collection portion 8. Further, the decrease in the width W20 of the suction passage 102 measured in the longitudinal direction A of the suction inlet 4 results in, for example, a decrease in channel cross-sectional area of the suction passage 102 with decreasing distance from the connection opening 101, reducing a reduction in pressure in the channel and a reduction in the suction force with decreasing distance from the connection opening 101.

In addition, the suction unit 100 includes the plurality of partition walls (i.e., the second partition walls) 25, each of which is arranged in the suction passage 102 and is arranged to extend from the suction inlet 4 to the side on which the connection opening 101 is defined, and includes the main passage (i.e., the second main passage) 21*a*, which has the center line CT of the suction passage 102 passing therethrough, and the plurality of division passages (i.e., the second division passages) 21*b* and 21*c*, which are arranged on both outer sides of the main passage 21*a* with respect to the longitudinal direction A with one of the partition walls 25 being arranged between the main passage 21*a* and an adjacent one of the division passages 21*b* and 21*c* on either side of the main passage 21*a*, the main passage 21*a* and the division passages 21*b* and 21*c* being divided from one another in the longitudinal direction A of the suction inlet 4 by the partition walls 25.

This contributes to reducing turbulence in the air in the vicinity of the suction inlet 4, which is connected to the electric blower 7. This leads to improved suction efficiency of the suction unit 100.

In addition, the upstream end of each partition wall (i.e., each first partition wall) 125 and the downstream end of each partition wall (i.e., each second partition wall) 25 are spaced from each other, and this enables the air to flow in the laminar state in the suction passage 102, leading to improved suction efficiency of the suction unit 100.

In addition, the upstream portions of the division passages (i.e., the first division passages) 121*b* and 121*c* and the downstream portions of the division passages (i.e., the second division passages) 21*b* and 21*c* are arranged to have equal channel widths, and this contributes to preventing the suction forces in the upstream portions of the division passages (i.e., the first division passages) 121*b* and 121*c* and the downstream portions of the division passages (i.e., the second division passages) 21*b* and 21*c* from decreasing from the upstream side toward the downstream side with respect to the direction in which the air flows.

In addition, the width W1 of the upstream end of the main passage (i.e., the second main passage) 21*a* measured in the longitudinal direction A is arranged to be greater than the width W11 of the downstream end of the main passage (i.e., the first main passage) 121*a* measured in the longitudinal direction A. This contributes to increasing the suction forces acting in the main passage (i.e., the second main passage) 21*a* and the main passage (i.e., the first main passage) 121*a*. This leads to improved suction efficiency of the suction unit 100.

Figure 7:
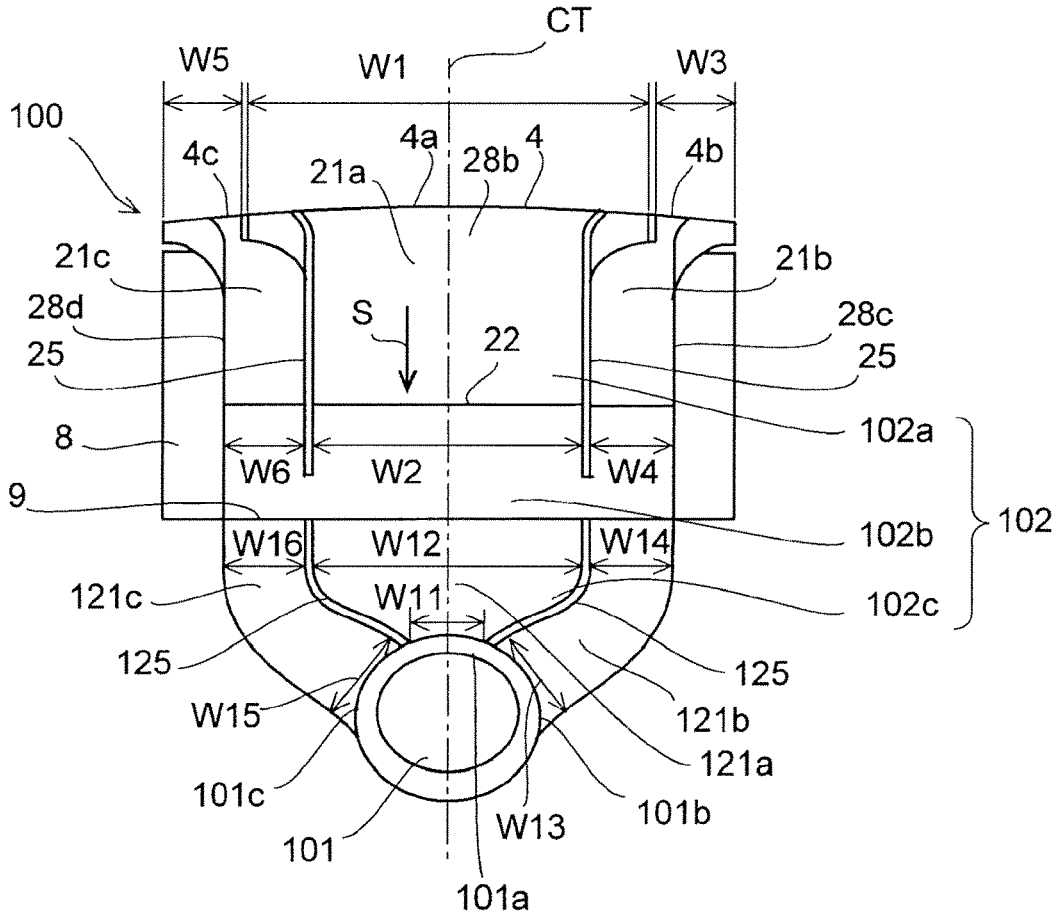
FIG. 7 is a sectional plan view of a suction unit according to a second preferred embodiment of the present invention.

Next, a second preferred embodiment of the present invention will now be described below. FIG. 7 is a sectional plan view of a suction unit 100 according to the second preferred embodiment. For the sake of convenience in description, members or portions that have their equivalents in the above-described first preferred embodiment illustrated in FIGS. 1 to 6 are denoted by the same reference numerals as those of their equivalents in the first preferred embodiment. The second preferred embodiment is different from the first preferred embodiment in the shape of partition walls 125. The second preferred embodiment is otherwise similar to the first preferred embodiment.

Each of division passages 121*b* and 121*c* is arranged to increase in a channel width with decreasing distance from a connection opening 101 in the vicinity of a downstream end thereof.

The present preferred embodiment is able to achieve beneficial effects similar to those of the first preferred embodiment. In addition, because each of the division passages 121*b* and 121*c* is arranged to increase in the channel width with decreasing distance from the connection opening 101, turbulence in the vicinity of the connection opening 101 can be further reduced. Thus, air flows can more smoothly enter into the connection opening 101 from a main passage 121*a* and the division passages 121*b* and 121*c*, resulting in improved suction efficiency of the suction unit 100.

Figure 8:
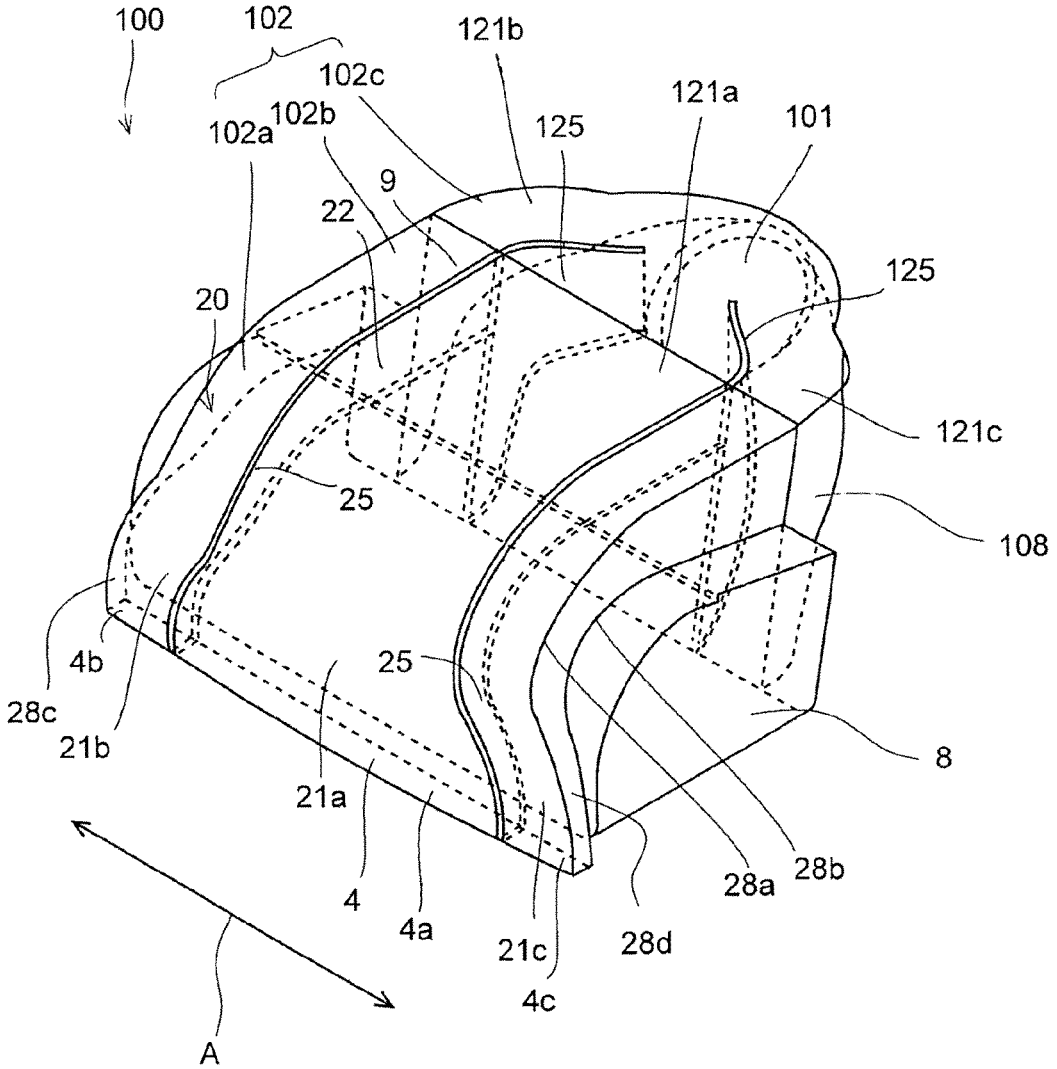
FIG. 8 is a perspective view of a suction unit according to a third preferred embodiment of the present invention.
Figure 9:
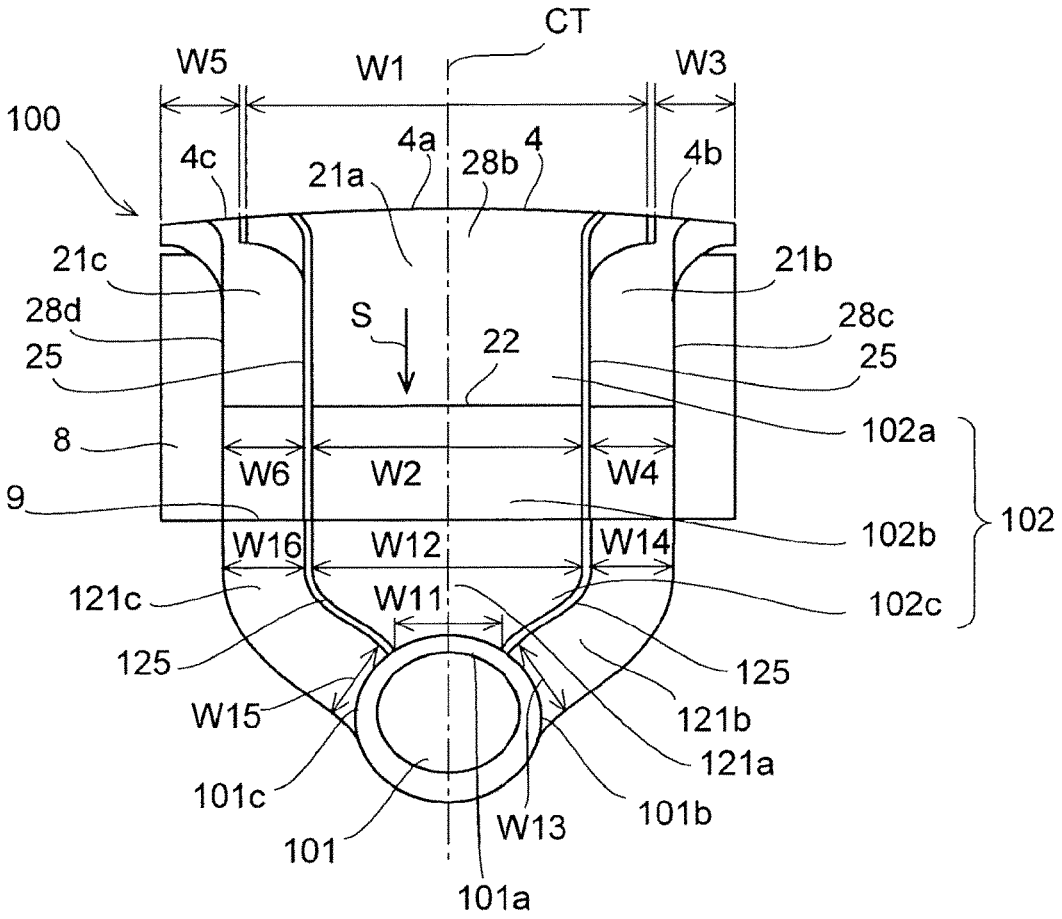
FIG. 9 is a sectional plan view of the suction unit according to the third preferred embodiment of the present invention.

Next, a third preferred embodiment of the present invention will now be described below. FIGS. 8 and 9 are a perspective view and a sectional plan view, respectively, of a suction unit 100 according to the third preferred embodiment. For the sake of convenience in description, members or portions that have their equivalents in the above-described first preferred embodiment illustrated in FIGS. 1 to 6 are denoted by the same reference numerals as those of their equivalents in the first preferred embodiment. The third preferred embodiment is different from the first preferred embodiment in the shape of partition walls 25. The third preferred embodiment is otherwise similar to the first preferred embodiment.

Each of the partition walls 25 is arranged to extend over both a first suction passage 102*a* and a second suction passage 102*b*, with a downstream end of the partition wall 25 being continuous with an upstream end of a corresponding partition wall 125 with a filter 9 therebetween. In the second suction passage 102*b*, each partition wall 25 is arranged to extend in a horizontal direction from a downstream end of a lower wall 28*b*, and a lower end of the partition wall 25 is arranged above a dust collection portion 8. That is, the upstream end of each partition wall (i.e., each first partition wall) 125 and the downstream end of the corresponding partition wall (i.e., the corresponding second partition wall) 25 are arranged to be continuous with each other.

The present preferred embodiment is able to achieve beneficial effects similar to those of the first preferred embodiment. In addition, the upstream end of each partition wall (i.e., each first partition wall) 125 is arranged to be continuous with the corresponding partition wall (i.e., the corresponding second partition wall) 25, and this enables air to smoothly flow from a main passage 21*a* and division passages 21*b* and 21*c* into a main passage 121*a* and division passages 121*b* and 121*c*, respectively. This contributes to preventing turbulence from occurring between the main passage 21*a* and the division passages 21*b* and 21*c* and, respectively, the main passage 121*a* and the division passages 121*b* and 121*c*, and improving suction forces of the suction unit 100.

Figure 10:
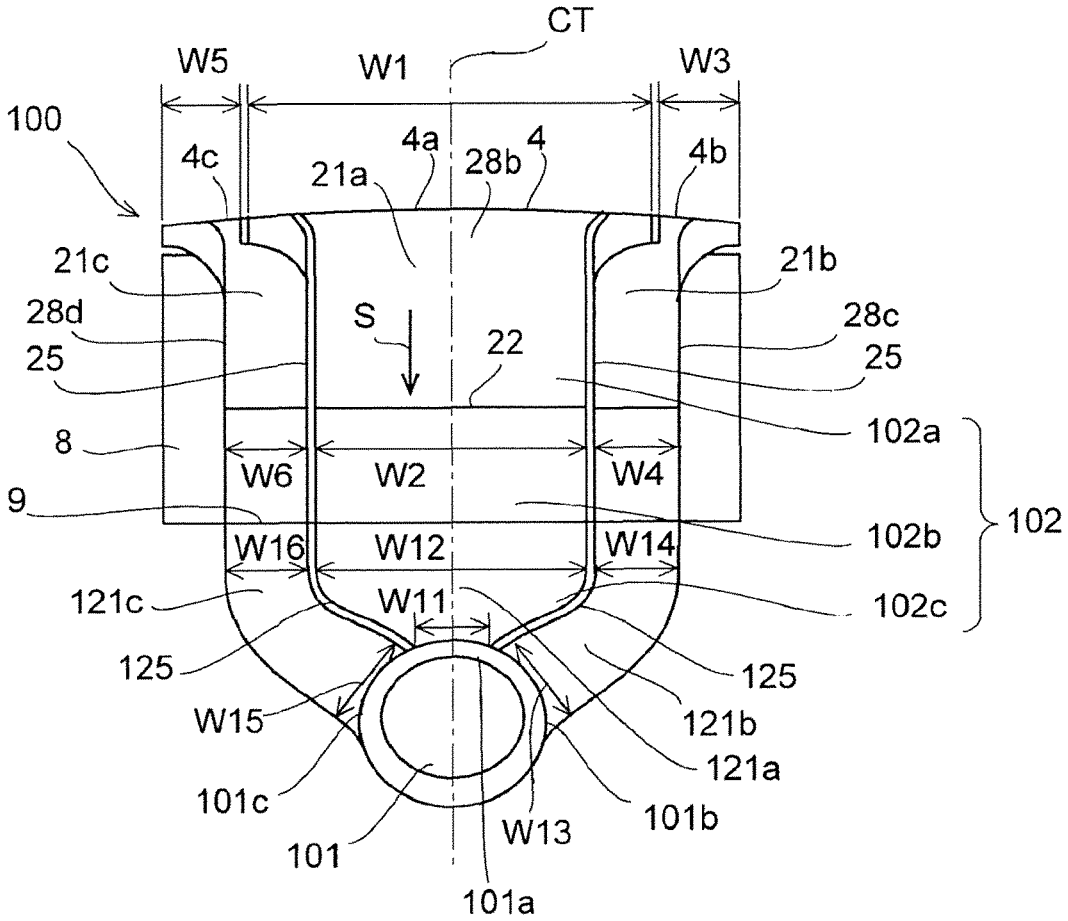
FIG. 10 is a sectional plan view of a suction unit according to a modification of the third preferred embodiment of the present invention.

FIG. 10 is a sectional plan view of a suction unit 100 according to a modification of the present preferred embodiment. Also in the present preferred embodiment, each of the division passages 121*b* and 121*c* may alternatively be arranged to increase in a channel width with decreasing distance from a connection opening 101 in the vicinity of a downstream end thereof, as in the second preferred embodiment.

Figure 11:
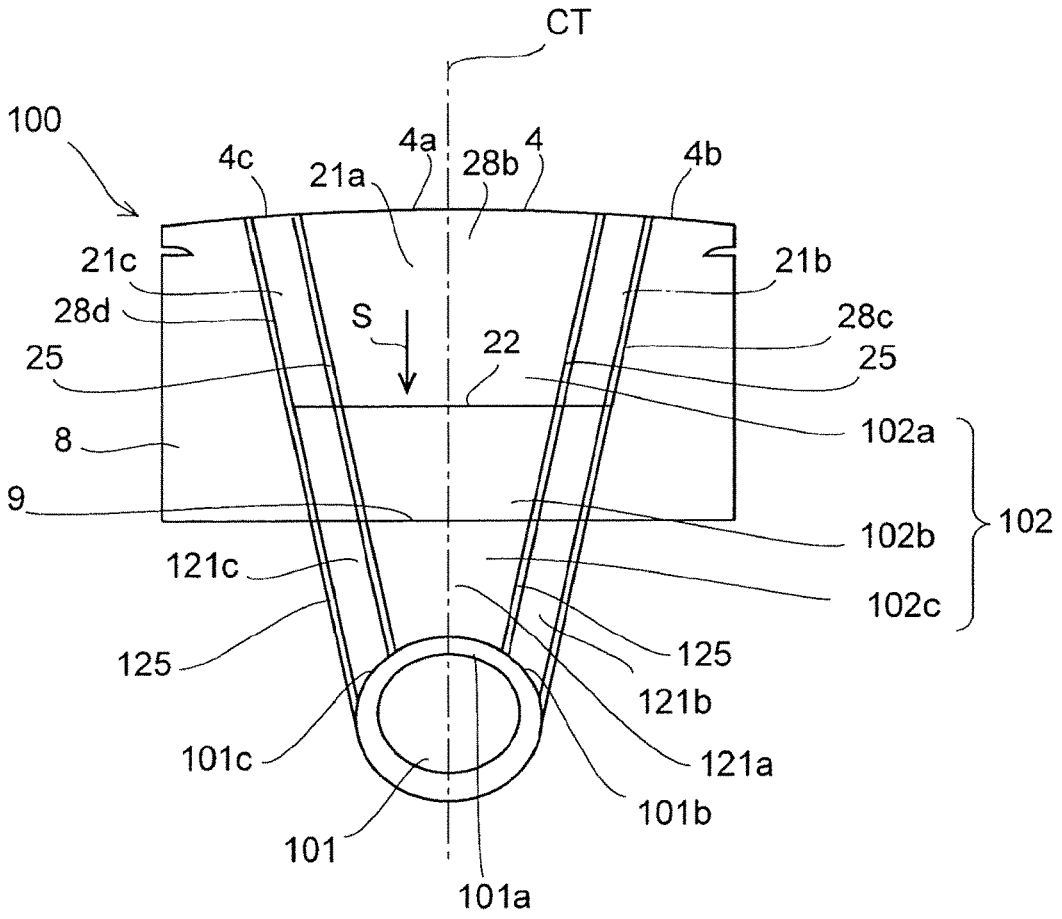
FIG. 11 is a sectional plan view of a suction unit according to a fourth preferred embodiment of the present invention.

Next, a fourth preferred embodiment of the present invention will now be described below. FIG. 11 is a sectional plan view of a suction unit 100 according to the fourth preferred embodiment. For the sake of convenience in description, members or portions that have their equivalents in the above-described first preferred embodiment illustrated in FIGS. 1 to 6 are denoted by the same reference numerals as those of their equivalents in the first preferred embodiment. The fourth preferred embodiment is different from the first preferred embodiment in the shape of partition walls 25 and 125. The fourth preferred embodiment is otherwise similar to the first preferred embodiment.

In a first suction passage 102*a*, a plurality of plate-shaped partition walls 25 are arranged side by side in the longitudinal direction A. Each partition wall 25 is arranged to extend over both the first suction passage 102*a* and a second suction passage 102*b*, and is arranged to extend in a straight line from a side on which a suction inlet 4 is defined to a side on which a connection opening 101 is defined.

Meanwhile, in a third suction passage 102*c*, a plurality of plate-shaped partition walls 125 are arranged side by side in the longitudinal direction A. Each partition wall 125 is arranged to extend in a straight line from the side on which the connection opening 101 is defined to the side on which the suction inlet 4 is defined, and a downstream end of each partition wall 25 is arranged to be continuous with an upstream end of a corresponding one of the partition walls 125 with a filter 9 therebetween.

Each of the partition walls 25 and 125 is defined by a plate perpendicular to an upper wall 28*a*, and the partition walls 25, which are two in number, and the partition walls 125, which are also two in number, are arranged to incline in such a manner as to approach each other as they extend away from the suction inlet 4 toward the connection opening 101 in a front view. That is, each of the partition walls (i.e., the first partition walls) 125 and the partition walls (i.e., the second partition walls) 25 is in the shape of a plate, and each partition wall 25 and a corresponding one of the partition walls 125 are arranged to continuously extend in a straight line from the side on which the suction inlet 4 is defined to the side on which the connection opening 101 is defined.

The present preferred embodiment is able to achieve beneficial effects similar to those of the third preferred embodiment. In addition, each of the partition walls 25 and 125 is in the shape of a plate, and each partition wall 25 and the corresponding one of the partition walls 125 are arranged to extend in a straight line from the side on which the suction inlet 4 is defined to the side on which the connection opening 101 is defined. This contributes to easily preventing a separation of an air flow passing in each of main passages 21*a* and 121*a* and division passages 21*b*, 21*c*, 121*b*, and 121*c* from any of the partition walls 25 and 125, and further reducing the likelihood of an occurrence of turbulence, which leads to improved suction forces of the suction unit 100.

Figure 12:
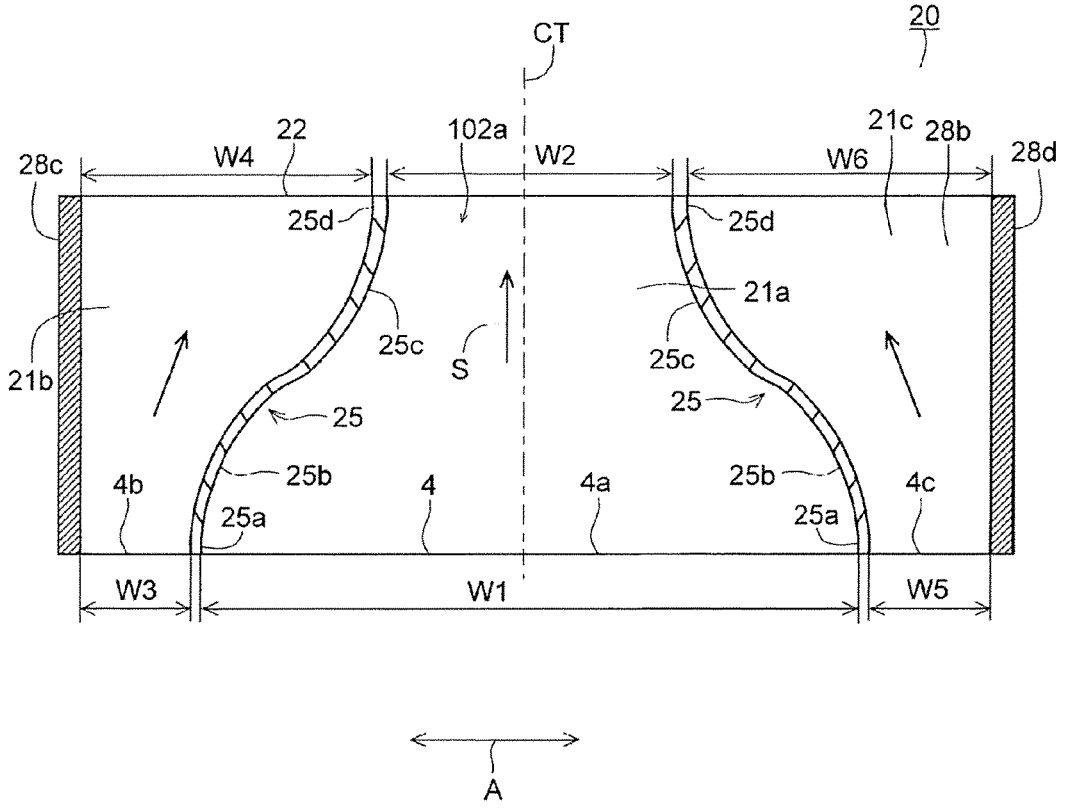
FIG. 12 is a sectional front view of a suction nozzle of a suction unit according to a fifth preferred embodiment of the present invention.

Next, a fifth preferred embodiment of the present invention will now be described below. FIG. 12 is a sectional front view of a suction nozzle 20 of a suction unit 100 according to the fifth preferred embodiment. For the sake of convenience in description, members or portions that have their equivalents in the above-described first preferred embodiment illustrated in FIGS. 1 to 6 are denoted by the same reference numerals as those of their equivalents in the first preferred embodiment. The fifth preferred embodiment is different from the first preferred embodiment in the shape of partition walls 25. The fifth preferred embodiment is otherwise similar to the first preferred embodiment.

Each partition wall 25 includes an upstream vertical portion 25*a*, a first curved portion 25*b*, a second curved portion 25*c*, and a downstream vertical portion 25*d* arranged in the order named from the upstream side to the downstream side with respect to a direction in which air flows. The upstream vertical portion 25*a* is arranged at an upstream end of the partition wall 25, and is arranged to be substantially perpendicular to the longitudinal direction A. That is, each partition wall 25 includes the upstream vertical portion 25*a*, which is substantially perpendicular to the longitudinal direction A, at the upstream end thereof. The first curved portion 25*b* is defined continuously with a downstream side of the upstream vertical portion 25*a*, and is arranged to curve so as to be convex away from a center line CT (i.e., outward in the longitudinal direction A). That is, each partition wall 25 includes the first curved portion 25*b*, which is defined continuously with the downstream side of the upstream vertical portion 25*a* and is arranged to curve so as to be convex away from the center line CT. The second curved portion 25*c* is defined continuously with a downstream side of the first curved portion 25*b*, and is arranged to curve so as to be convex toward the center line CT (i.e., inward in the longitudinal direction A). That is, each partition wall 25 includes the second curved portion 25*c*, which is defined continuously with the downstream side of the first curved portion 25*b* and is arranged to curve so as to be convex toward the center line CT. The downstream vertical portion 25*d* is defined continuously with the second curved portion 25*c* at a downstream end, and is arranged to be substantially perpendicular to the longitudinal direction A. That is, each partition wall 25 includes, at the downstream end thereof, the downstream vertical portion 25*d*, which is defined continuously with the second curved portion 25*c* and is arranged to be substantially perpendicular to the longitudinal direction A.

Thus, the upstream end of each partition wall 25 is arranged outward of the downstream end thereof with respect to the longitudinal direction A, so that a width W1 of a main passage 21*a* at a suction inlet 4*a* measured in the longitudinal direction A is greater than a width W2 of the main passage 21*a* at an outlet 22 measured in the longitudinal direction A. A width W3 of a suction inlet 4*b* measured in the longitudinal direction A is smaller than a width W4 of a division passage 21*b* at the outlet 22 measured in the longitudinal direction A. A width W5 of a suction inlet 4*c* measured in the longitudinal direction A is smaller than a width W6 of a division passage 21*c* at the outlet 22 measured in the longitudinal direction A.

The width W3 of the suction inlet 4*b* and the width W5 of the suction inlet 4*c* are arranged to be substantially equal to each other, and the width W1 of the suction inlet 4*a* is arranged to be greater than the width W3 of the suction inlet 4*b* and the width W5 of the suction inlet 4*c*. The width W4 of the division passage 21*b* at the outlet 22 and the width W6 of the division passage 21*c* at the outlet 22 are arranged to be substantially equal to each other. In addition, since each of the division passages 21*b* and 21*c* becomes wider on the downstream side, each of the width W4 of the division passage 21*b* at the outlet 22 and the width W6 of the division passage 21*c* at the outlet 22 approaches the width W2 of the main passage 21*a* at the outlet 22. In the present preferred embodiment, the width W2 of the main passage 21*a* at the outlet 22, the width W4 of the division passage 21*b* at the outlet 22, and the width W6 of the division passage 21*c* at the outlet 22 are arranged to be substantially equal to one another. Note that the width W3 of the suction inlet 4*b* and the width W5 of the suction inlet 4*c* may be different from each other.

When a cleaning operation of an electric vacuum cleaner 1 is started, and air flows into the main passage 21*a* and the division passages 21*b* and 21*c* through the suction inlets 4*a*, 4*b*, and 4*c*, respectively, as indicated by arrows S, the upstream vertical portion 25*a* of each partition wall 25 contributes to reducing turbulence in the vicinity of the upstream end of the partition wall 25. Thus, an air flow smoothly enters into each of the main passage 21*a* and the division passages 21*b* and 21*c*. The air which has flowed into each of the main passage 21*a* and the division passages 21*b* and 21*c* flows along the first curved portion 25*b* and then the second curved portion 25*c*. Thus, the air which has flowed into each of the division passages 21*b* and 21*c* is smoothly guided toward the center line CT. This contributes to reducing turbulence in the air in each of the division passages 21*b* and 21*c*, and causing the air to flow more smoothly therein.

In addition, because the widths W4 and W6 of the division passages 21*b* and 21*c*, respectively, at the outlet 22 approach the width W2 of the main passage 21*a* at the outlet 22, suction forces of equivalent magnitude act in the main passage 21*a* and the division passages 21*b* and 21*c*. Thus, suction forces are substantially evenly distributed in the longitudinal direction A of a suction inlet 4.

In addition, the width W1 of the suction inlet 4*a* of the main passage 21*a*, where turbulence does not easily occur, is arranged to be greater than the widths W3 and W5 of the suction inlets 4*b* and 4*c*, respectively, and this leads to improved suction efficiency of the suction nozzle 20.

In addition, the downstream vertical portion 25*d* of each partition wall 25 contributes to causing air which has reached a downstream portion of each of the main passage 21*a* and the division passages 21*b* and 21*c* to be smoothly guided downstream of the outlet 22.

In the present preferred embodiment, the plurality of partition walls (i.e., the second partition walls) 25, which are arranged to divide a first suction passage 102*a* into the main passage 21*a* and the division passages 21*b* and 21*c* which are divided from one another in the longitudinal direction A of the suction inlet 4, are provided in the suction nozzle 20. This prevents a narrowing of a channel on a side closer to an air inlet of an electric blower 7 from causing flows of air sucked in through both end portions of the suction inlet 4 with respect to the longitudinal direction A to abruptly bend toward the center line CT immediately after entering into the first suction passage 102*a*, and thus contributes to reducing turbulence in the air.

In addition, the width W1 of the main passage 21*a* at the suction inlet 4 measured in the longitudinal direction A is greater than the width W2 of the main passage 21*a* at the outlet 22 measured in the longitudinal direction A. This causes each of the widths W4 and W6 of the division passages 21*b* and 21*c*, respectively, at the outlet 22 to approach the width W2 of the main passage 21*a* at the outlet 22, resulting in an increase in the suction force that acts in each of the division passages 21*b* and 21*c*. Thus, the suction forces are substantially evenly distributed over the suction inlet 4 in the longitudinal direction A. This leads to improved suction efficiency of the suction nozzle 20.

In addition, each partition wall 25 includes the upstream vertical portion 25*a*, which is substantially perpendicular to the longitudinal direction A, at an upstream end of the first suction passage 102*a*. This contributes to further reducing the turbulence in the vicinity of the upstream end of the partition wall 25.

In addition, each partition wall 25 includes the first curved portion 25*b*, which is defined continuously with the downstream side of the upstream vertical portion 25*a* and is arranged to curve so as to be convex away from the center line CT. This contributes to causing air sucked in through the suction inlets 4*b* and 4*c* at both end portions with respect to the longitudinal direction A to smoothly flow in the division passages 21*b* and 21*c*.

In addition, each partition wall 25 includes the second curved portion 25*c*, which is defined continuously with the downstream side of the first curved portion 25*b* and is arranged to curve so as to be convex toward the center line CT. This contributes to causing the air sucked in through the suction inlets 4*b* and 4*c* at both end portions with respect to the longitudinal direction A to be smoothly guided to a downstream portion of the first suction passage 102*a*.

In addition, each partition wall 25 includes, at the downstream end thereof, the downstream vertical portion 25*d*, which is defined continuously with the second curved portion 25*c* and is arranged to be substantially perpendicular to the longitudinal direction A. This contributes to causing the air flowing in each of the main passage 21*a* and the division passages 21*b* and 21*c* to be smoothly guided to the outlet 22.

In addition, the width W1 of the main passage 21*a* at the suction inlet 4 measured in the longitudinal direction A is arranged to be greater than each of the widths W3 and W5 of the division passages 21*b* and 21*c*, respectively, at the suction inlet 4 measured in the longitudinal direction A. This increase in the width W1 of the main passage 21*a*, where turbulence does not easily occur, leads to improved suction efficiency of the suction nozzle 20.

Note that, in the present preferred embodiment, the first curved portion 25*b* may alternatively be arranged to extend from a downstream end of the upstream vertical portion 25*a* to the outlet 22 with the second curved portion 25*c* and the downstream vertical portion 25*d* being omitted.

Figure 13:
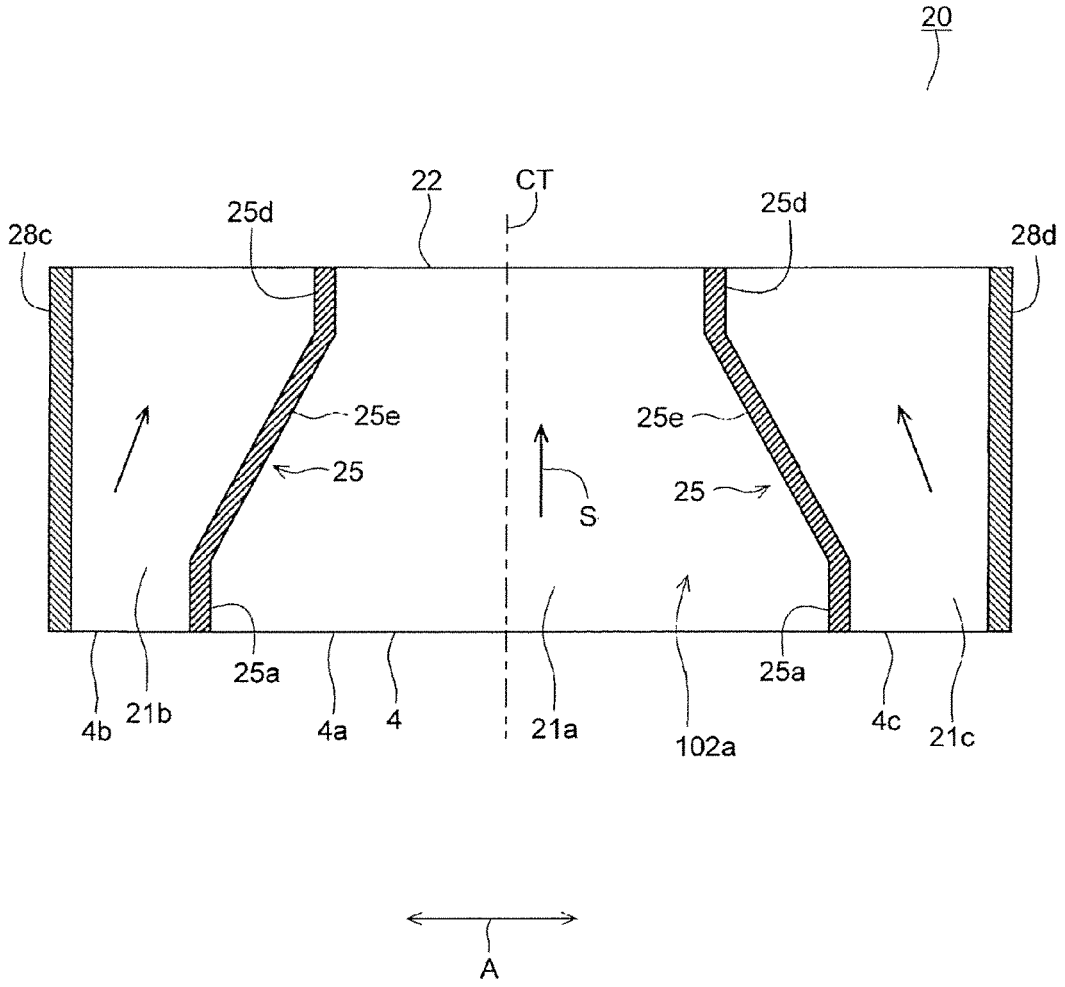
FIG. 13 is a sectional front view of a suction nozzle of a suction unit according to a sixth preferred embodiment of the present invention.

Next, a sixth preferred embodiment of the present invention will now be described below. FIG. 13 is a sectional front view of a suction nozzle 20 of a suction unit 100 according to the sixth preferred embodiment. For the sake of convenience in description, members or portions that have their equivalents in the above-described first preferred embodiment illustrated in FIGS. 1 to 6 are denoted by the same reference numerals as those of their equivalents in the first preferred embodiment. The sixth preferred embodiment is different from the first preferred embodiment in the shape of partition walls 25. The sixth preferred embodiment is otherwise similar to the first preferred embodiment.

Each partition wall 25 includes an upstream vertical portion 25*a*, a straight portion 25*e*, and a downstream vertical portion 25*d* arranged in the order named from the upstream side to the downstream side with respect to a direction in which air flows. In the sixth preferred embodiment, each partition wall 25 includes the downstream vertical portion 25*d*, which is arranged to be substantially perpendicular to the longitudinal direction A, at a downstream end thereof. This causes air which has reached a downstream portion of each of a main passage 21*a* and division passages 21*b* and 21*c* to be smoothly guided downstream of an outlet 22. The straight portion 25*e* is defined continuously with each of a downstream end of the upstream vertical portion 25*a* and an upstream end of the downstream vertical portion 25*d*, and is arranged to extend in a straight line.

The present preferred embodiment is also able to achieve beneficial effects similar to those of the first preferred embodiment. Note that the upstream vertical portion 25*a* or the downstream vertical portion 25*d* may alternatively be omitted in the present preferred embodiment.

Preferred embodiments of the present invention are applicable to suction units and electric vacuum cleaners including suction units.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A suction unit to be provided in an electric vacuum cleaner including an electric blower, the suction unit comprising:

a suction inlet arranged to extend in a longitudinal direction which is predetermined, and arranged opposite to a surface to be cleaned;

a connection opening to be connected to the electric blower;

a suction passage arranged to extend along a center line joining a middle of the suction inlet in the longitudinal direction and a middle of the connection opening in the longitudinal direction to connect the suction inlet and the connection opening; and a plurality of first partition walls each of which is arranged in the suction passage, and is arranged to extend from a side on which the connection opening is defined to a side on which the suction inlet is defined;

wherein the suction passage includes:

a first main passage having the center line of the suction passage passing therethrough; and a plurality of first division passages arranged on both outer sides of the first main passage with respect to the longitudinal direction with one of the first partition walls being arranged between the first main passage and an adjacent one of the first division passages on either side of the first main passage, the first main passage and the first division passages being divided from one another in the longitudinal direction of the suction inlet by the first partition walls, wherein the suction unit further comprising:

a dust collection portion arranged below the suction passage, wherein a rear portion of the dust collection portion is arranged to open into a portion of the suction passage on an upper side thereof.

2. The suction unit according to claim 1, wherein an upstream end of each first partition wall is arranged on a side of a channel midpoint between the suction inlet and the connection opening in the suction passage closer to the connection opening.

3. The suction unit according to claim 1, wherein a width of a downstream end of the first main passage measured in the longitudinal direction is arranged to be different from a width of a downstream end of each first division passage.

4. The suction unit according to claim 1, wherein the first division passages on left and right sides are arranged to have equal widths at downstream ends thereof.

5. The suction unit according to claim 1, wherein each first division passage is arranged to increase in a channel width with decreasing distance from the connection opening in a vicinity of a downstream end thereof.

6. The suction unit according to claim 1, wherein a lower end of an upstream end of each first partition wall is arranged at a level lower than that of a lower end of a downstream end of the first partition wall.

7. The suction unit according to claim 1, wherein a width of the suction passage measured in the longitudinal direction of the suction inlet is arranged to be smaller than a width of the dust collection portion measured in the longitudinal direction of the suction inlet.

8. The suction unit according to claim 1, further comprising:

a plurality of second partition walls each of which is arranged in the suction passage, and is arranged to extend from the side on which the suction inlet is defined to the side on which the connection opening is defined, wherein the suction passage further includes:

a second main passage having the center line of the suction passage passing therethrough; and a plurality of second division passages arranged on both outer sides of the second main passage with respect to the longitudinal direction with one of the second partition walls being arranged between the second main passage and an adjacent one of the second division passages on either side of the second main passage, the second main passage and the second division passages being divided from one another in the longitudinal direction of the suction inlet by the second partition walls.

9. The suction unit according to claim 8, wherein an upstream end of each first partition wall and a downstream end of each second partition wall are spaced from each other.

10. The suction unit according to claim 8, wherein an upstream end of each first partition wall and a downstream end of a corresponding one of the second partition walls are arranged to be continuous with each other.

11. The suction unit according to claim 8, wherein upstream portions of the first division passages and downstream portions of the second division passages are arranged to have equal channel widths.

12. The suction unit according to claim 8, wherein a width of an upstream end of the second main passage measured in the longitudinal direction is arranged to be greater than a width of a downstream end of the first main passage measured in the longitudinal direction.

13. The suction unit according to claim 12, wherein each second partition wall includes a downstream vertical portion arranged to be substantially perpendicular to the longitudinal direction at a downstream end thereof.

14. The suction unit according to claim 8, wherein each second partition wall includes an upstream vertical portion arranged to be substantially perpendicular to the longitudinal direction at an upstream end thereof.

15. The suction unit according to claim 14, wherein each second partition wall further includes a first curved portion defined continuously with a downstream side of the upstream vertical portion, and arranged to curve so as to be convex away from the center line.

16. The suction unit according to claim 15, wherein each second partition wall further includes a second curved portion defined continuously with a downstream side of the first curved portion, and arranged to curve so as to be convex toward the center line.

17. The suction unit according to claim 16, wherein each second partition wall further includes, at a downstream end thereof, a downstream vertical portion defined continuously with the second curved portion, and arranged to be substantially perpendicular to the longitudinal direction.

18. The suction unit according to claim 8, wherein each of the first and second partition walls is in a shape of a plate, and each second partition wall and a corresponding one of the first partition walls are arranged to continuously extend in a straight line from the side on which the suction inlet is defined to the side on which the connection opening is defined.

* * * * *